US006945218B2

(12) United States Patent
Patterson

(10) Patent No.: US 6,945,218 B2
(45) Date of Patent: Sep. 20, 2005

(54) ROTARY PISTONS

(75) Inventor: Albert W. Patterson, Ontario (CA)

(73) Assignee: 1564330 Ontario Inc., Ontario (CA)

( * ) Notice: Subject to any disclaimer, the term of this patent is extended or adjusted under 35 U.S.C. 154(b) by 0 days.

(21) Appl. No.: 10/680,236

(22) Filed: Oct. 8, 2003

(65) Prior Publication Data

US 2005/0079084 A1 Apr. 14, 2005

(51) Int. Cl.[7] ..... F01C 1/00
(52) U.S. Cl. ..... 123/264; 418/268; 418/260
(58) Field of Search ..... 123/243; 418/268, 418/264, 159, 152, 260

(56) References Cited

U.S. PATENT DOCUMENTS

| | | | | |
|---|---|---|---|---|
| 2,728,330 A | * | 12/1955 | Petersen | 123/243 |
| 3,431,861 A | * | 3/1969 | Martin | 418/268 |
| 3,464,395 A | * | 9/1969 | Kelly | 123/243 |
| 3,478,728 A | * | 11/1969 | Kelly | 418/268 |
| 3,514,237 A | * | 5/1970 | Spyridakis | 418/152 |
| 3,863,611 A | * | 2/1975 | Bakos | 418/147 |
| 3,873,253 A | * | 3/1975 | Eickmann | 418/147 |
| 4,917,584 A | | 4/1990 | Sakamaki et al. | |
| 4,958,995 A | * | 9/1990 | Sakamaki et al. | 418/152 |
| 6,554,596 B1 | | 4/2003 | Patterson | |
| 6,776,136 B1 | * | 8/2004 | Kazempour | 123/243 |

FOREIGN PATENT DOCUMENTS

| | | | | |
|---|---|---|---|---|
| DE | 2628539 A1 | * | 1/1977 | F01C 1/34 |
| DE | 29720052 U1 | * | 2/1998 | F01C 1/344 |
| GB | 2078303 A | * | 1/1982 | F01C 1/344 |
| GB | 2 401 402 A | | 11/2004 | |
| JP | 57-032095 | | 2/1985 | |

OTHER PUBLICATIONS

UK Search Report for Application No. GB0422435.8 dated Dec. 8, 2004.

* cited by examiner

*Primary Examiner*—Thai-Ba Trieu
(74) *Attorney, Agent, or Firm*—Nixon Peabody LLP; Jeffrey L. Costellia

(57) ABSTRACT

A rotary piston for use in pumps or motors, the piston having a cylindrical rotor with radially movable vanes rotating within a housing, the movement of the vanes controlled by pins of the vanes travelling in races in the housing.

12 Claims, 5 Drawing Sheets

ROTARY PISTONS

FIELD OF THE INVENTION

The present invention relates to a rotary piston for use in pumps or motors.

BACKGROUND OF THE INVENTION

Rotary pistons, in the nature of encased rotors with radially extending vanes which move in and out of the rotors, depending upon their location within the casing used, for example, as pumps or turbines, are known. One such device is described in U.S. Pat. No. 6,554,596 of Albert and David Patterson issued Apr. 29, 2003, in which the vane movement, in and out of the rotor, is achieved by cam surfaces within the casing which act on both inner and outer edges of the vanes.

Other known constructions of such vane "motors" require centrifugal force, through rotation of the rotor, to force the vanes out.

Problems with such arrangements, if applied to hydraulics, include leakage of fluid between the vanes and consequent inability to effectively and efficiently handle fluids under high pressure. Of necessity, such devices have conventionally been of relatively small size, and, while they have been able to operate at fast speeds, they have been able to move only relatively low volumes of fluid.

It is an object of the present invention to provide a hydraulic pump for liquid or air which will operate efficiently and effectively at medium or high pressures and handle high fluid volumes and high torque at low, medium or high fluid pressure.

SUMMARY OF THE INVENTION

In accordance with the present invention, there is provided a rotary piston which comprises a shaft to rotate about a longitudinal axis, and a rotor centrally secured to the shaft. The rotor has a body with a cylindrical surface extending between spaced ends. A rotor disk secured to the rotor at each end, and secured at its centre to the shaft. A housing encases the rotor and shaft within an internal cavity, with the shaft extending outside of the housing. The housing has interior end walls adjacent to the rotor disks and an interior sidewall. Fluid inlet and fluid outlet ports are located in the sidewall, second portion. A first portion of the interior sidewall of the housing is cylindrical and curved with constant radius over an angle of about approximately 180°. This portion is spaced a constant distance from confronting portions of the cylindrical surface of the rotor. A second portion of the interior sidewall of the housing extends between the extremities of the first portion of the interior sidewall and is of curvature of greater radius than that of the first portion. The cylindrical surface of the rotor is proximal to the interior sidewall of the housing at a point between the inlet and outlet ports about midway on the second portion. Three or more equally spaced, radially oriented slots in the rotor extend longitudinally across the cylindrical surface of the rotor. The fluid inlet and outlet ports are located in this second portion. Three or more similar vanes, each having internal and external edges extending between sides, are provided, each vane slidably seated in a different one of the slots. Each vane is movable radially in its corresponding slot between an extended position with the external edge of the vane adjacent the interior sidewall of the housing, and a retracted position wherein the external edge of the vane does not extend beyond the cylindrical surface of the rotor. The vanes are spaced from adjacent vanes about the rotor such that there is always at least one vane positioned between the inlet and outlet ports.

An ear extends beyond the external edge of each vane at each of its sides and a pin is secured to each ear and extends inwardly towards the other vane's ear. The pin of each ear is seated in one of a pair of races continuously extending in portions of the interior sidewall of the housing, the races circumscribing the shaft and formed so as to provide proper extending and retracting movement of the vanes as the pins move along it during rotation of the rotor. A plurality of slots are formed in the rotor disks, aligned with the rotor slots and slidably receiving the sides of the vanes and corresponding ears. The rotor disk, housing and vanes are constructed so that, during operation of the device, fluid entering the housing through the inlet port is carried by the rotor in compartments formed between adjacent vanes, the rotor surface between those vanes, the rotor disk and corresponding portions of the end walls and sidewall of the housing, until the adjacent vanes encompass the outlet port where the fluid is allowed to leave the compartment.

The device according to the present application can be constructed, as will be explained in more detail hereinafter, so that extremely high torque can be provided at low, medium or high fluid pressures within the housing. Unlike conventional prior art hydraulic pumps, the principles of the present invention are suitable for high torque, slow speed applications. A wide range of applications for the device according to the present invention are provided in the context, for example, of motors, pumps and compressors.

BRIEF DESCRIPTION OF THE DRAWINGS

These and other advantages of the invention will become apparent upon reading the following detailed description and upon referring to the drawings in which.

Figure 1:
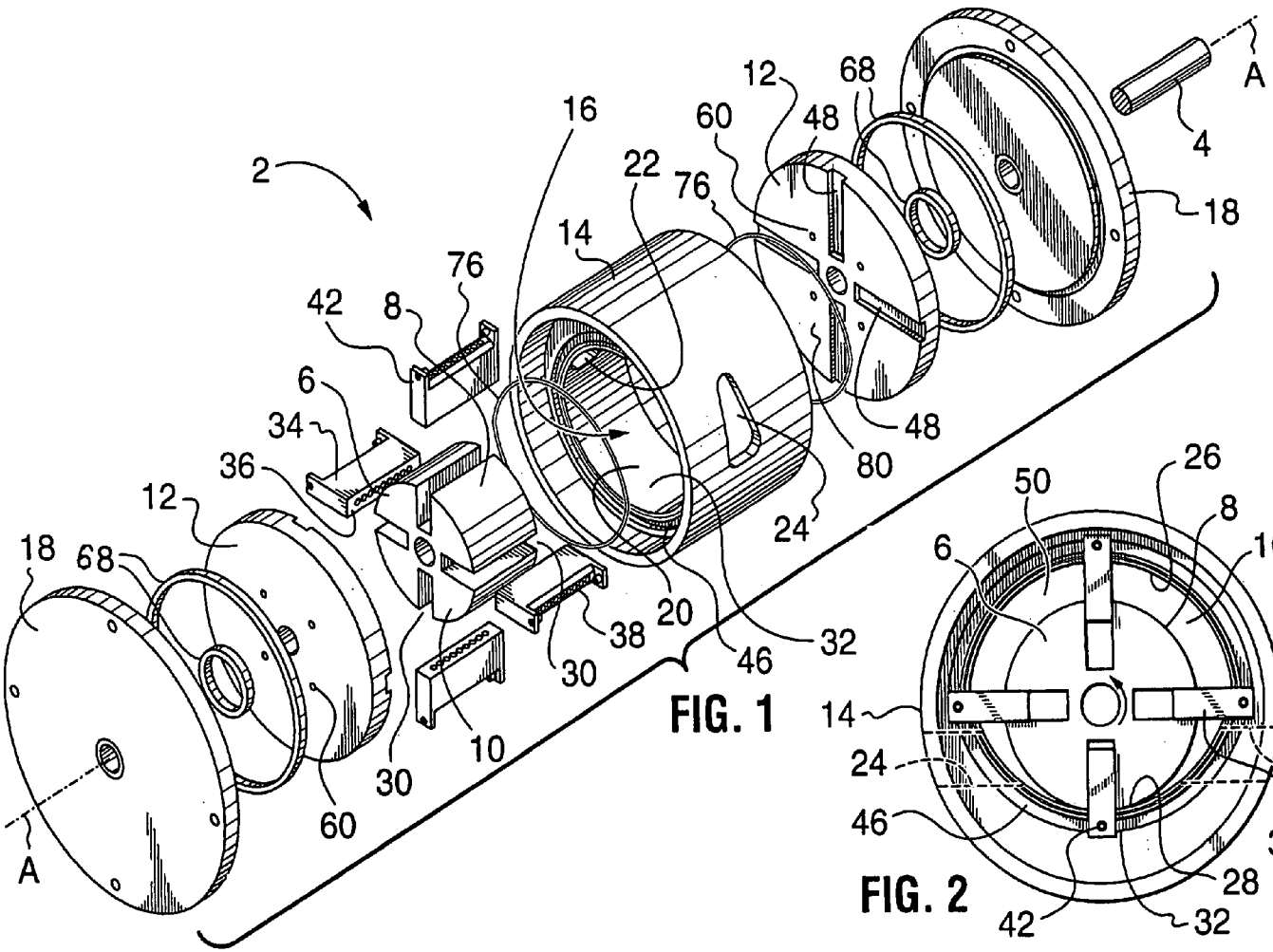
FIG. 1 is an exploded perspective view of an example embodiment of rotary piston device according to the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to FIG. 1, there is illustrated a rotary piston device 2 according to the present invention. The rotary piston device 2 comprises a shaft 4 rotating about a longitudinal axis A—A. A rotor 6 is centrally secured to shaft 4. Rotor 6 has a body with a cylindrical surface 8 extending between spaced ends 10. A rotor disk 12 is provided at each end of rotor 6, secured at its center to shaft 4 and to the corresponding end 10 of rotor 6. Shaft 4, rotor 6 and rotor disks 12 may be of integral construction.

A housing 14 encases shaft 4, rotor 6 and rotor disks 12 within an internal cavity 16. Shaft 4 extends outside housing 14, as illustrated. Housing 14 has end walls 18 adjacent to rotor disks 12 and an interior sidewall 20. Fluid inlet port 22 and fluid outlet port 24 are provided in interior sidewall 20.

Figure 2:
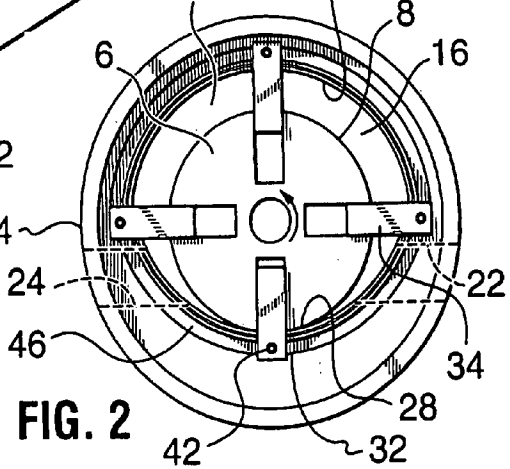
FIG. 2 is a lateral section view of the device of FIG. 1.

As can be seen in FIG. 2, first portion 26 of the interior sidewall 20 is cylindrical and curved with constant radius over an angle of about 180°. This portion is spaced a constant distance from corresponding portions of the cylindrical surface 8 of rotor 6. A second portion 28 of the interior sidewall 20 extends between the extremities of this first portion 26 of the interior sidewall. The second portion 28 has a curvature of greater radius than that of the first portion.

Three or more (four are illustrated) equally spaced, radially oriented slots 30 in rotor 6 extend across its cylindrical surface 8. This cylindrical surface 8 is proximal to the interior sidewall 20 of the housing 14 at a point 32 on portion 28, about midway between the inlet and outlet ports 22 and 24. Inlet and outlet ports 22 and 24 are located in this second portion 28.

Three or more (again, four are illustrated) similar vanes 34 are slidably seated in the slots 30 of rotor 6 as illustrated. Each vane 34 has an internal edge 36 and an external edge 38 extending between sides 40 of the vanes. Each vane 34 is movable radially in its corresponding slot between an extended position with the external edge 38 of the vane adjacent first portion 26 of the interior sidewall of the housing and a retracted position when the vane passes point 32, where that external edge 38 is retracted and does not extend beyond the cylindrical surface of the rotor. The vanes 34 are spaced from each other about the rotor such that there is always at least one vane positioned between the inlet and outlet ports 22 and 24. An ear 42 extends beyond the external surface of each vane 34 at each of its sides 40. A pin 44 is secured to each ear 42 and extends inwardly, as illustrated (FIG. 1) towards the pin on the other ear 42 of that vane. That pin 44 for each ear is seated in one of a pair of oppositely facing races or grooves 46 which formed in portions of the interior sidewall 20 of housing 14. Each race 46 is continuous and circumscribes the shaft 4 so as to provide proper extending and retracting movement of the vanes as its corresponding pins move along it during rotation of the rotor.

As can be seen in FIG. 1, a plurality of slots 48 are provided in rotor disks 12. These slots 48 are aligned with corresponding rotor slots 30 and slidably receive the sides 40 of the vanes 34 and their corresponding ears 42. Ears 42 are seated flushly in slots 48 so that their confronting surfaces are flush with and do not extend beyond the inner surface of their corresponding rotor disk 12.

As will be described in more detail subsequently, the rotor disk 6, housing 14 and vanes 34 are constructed so that, during operation of the device, liquid or gas entering housing 14 through inlet port 22 is carried by the rotor 6, in compartments 50 formed between adjacent vanes 34, the rotor disks 12 and rotor surface 8 between those vanes and confronting portions of the sidewall 20 and end walls 18 of housing 14, until the adjacent vanes encompass the outlet port 24 where the fluid is allowed to escape.

Figure 3:
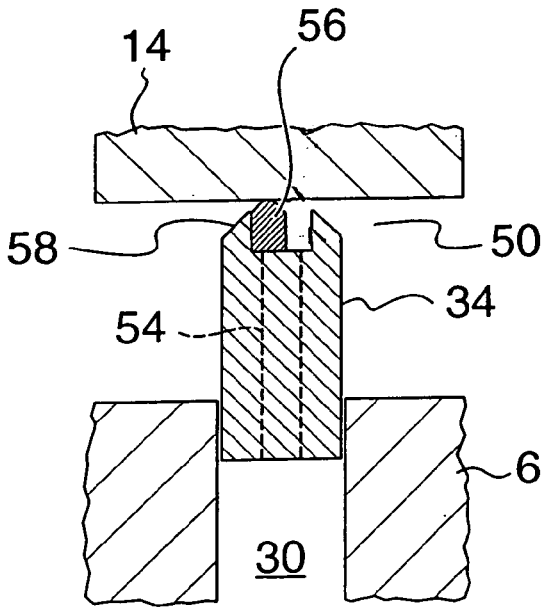
FIG. 3 is an enlarged partial view, in section of a vane and rotor of the device of FIG. 1.
Figure 4A:
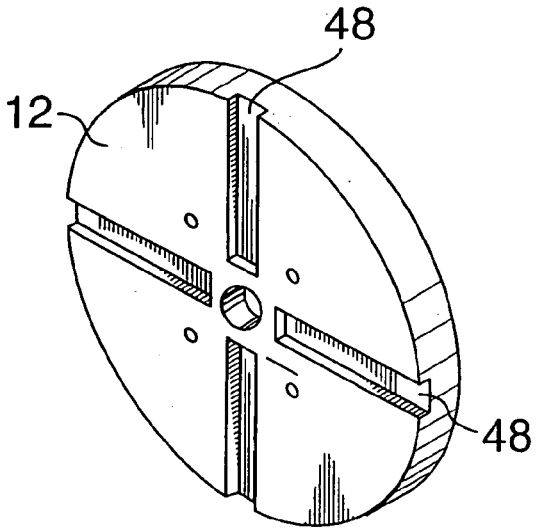
FIG. 4*a* is a perspective view of one of the rotor disks of the rotary piston of the present invention.

It is preferred that vanes 34 be as lightweight as possible, while maintaining their strength. This is accomplished for example by having vanes with hollowed portions, the hollowed portions extending from the internal edge 36 to the external edge 38. In the embodiment illustrated, which permits rotation of the shaft and rotor in either direction, one or more apertures 54 extend from internal edge 36 to external edge 38 of each vane. An external vane seal 56, which may be made for example of brass, is movably seated within a pocket 58 in external edge 38, both external vane seal 56 and pocket 58 extending the length of that external edge. This seal is forced, under pressure from fluid in the adjacent "upstream" compartment 50 (to the right of vane 3 in FIG. 3), to the opposite side of pocket 58, enabling fluid from that compartment 50 to pass down through apertures 54, to the bottom of the corresponding slot 30. In this way, high pressure from the fluid in that compartment 50 is passed to the bottom of this slot 30. Since greater surface area is exposed to the high pressure fluid of this compartment 50 by internal edge 36 of vane 34 than that formed by the exposed surface of pocket 58 plus the exposed external edge 38 of vane 34 and the exposed upper surface of external vane seal 56, additional upward sealing force between the vane and the interior sidewall 20 of housing 14 is provided to complement the upward forces exerted on vane 34 by pins 44 in races 46. This feature significantly assists the sealing of fluid within a particular compartment 50 as it picks up fluid, under pressure as that compartment passes inlet port 22, and reduces its ability to escape into the adjacent, downstream compartment 50, on the other (left) side of that vane 34, until such time as that vane passes outlet port 24, at which point the pressure in that first chamber 50 is removed or reduced.

If the shaft 4 and rotor 6 are to move in the opposite direction, then the external vane seal 56 will move to the other side of pocket 58, as the higher pressure fluid will be in the other compartment 50 (to the left of the vane 34 in FIG. 3), this external vane seal 56 still providing, on its other (left) side, an opening through aperture 54 for higher pressure fluid from that compartment 50, to pass down vane 34 to the bottom of slot 30. The seals, vanes, rotor and turbine otherwise operate in a similar fashion to that which has already been described.

Figure 5A:
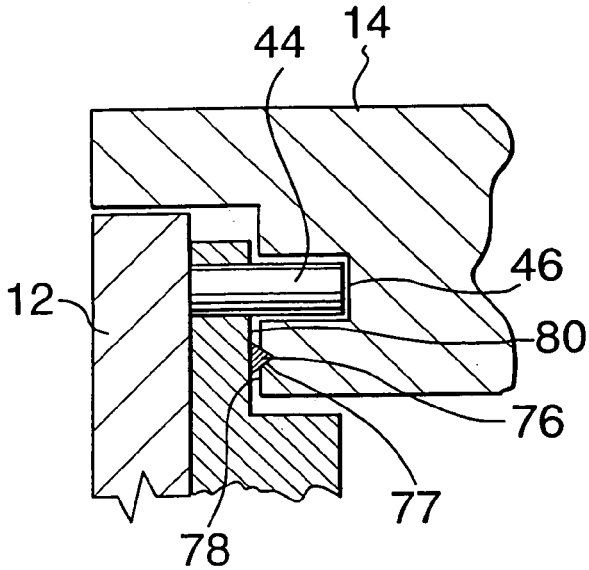
FIG. 5*a* is an enlarged view, in section, of a portion of the device as illustrated in FIG. 5.
Figure 4:
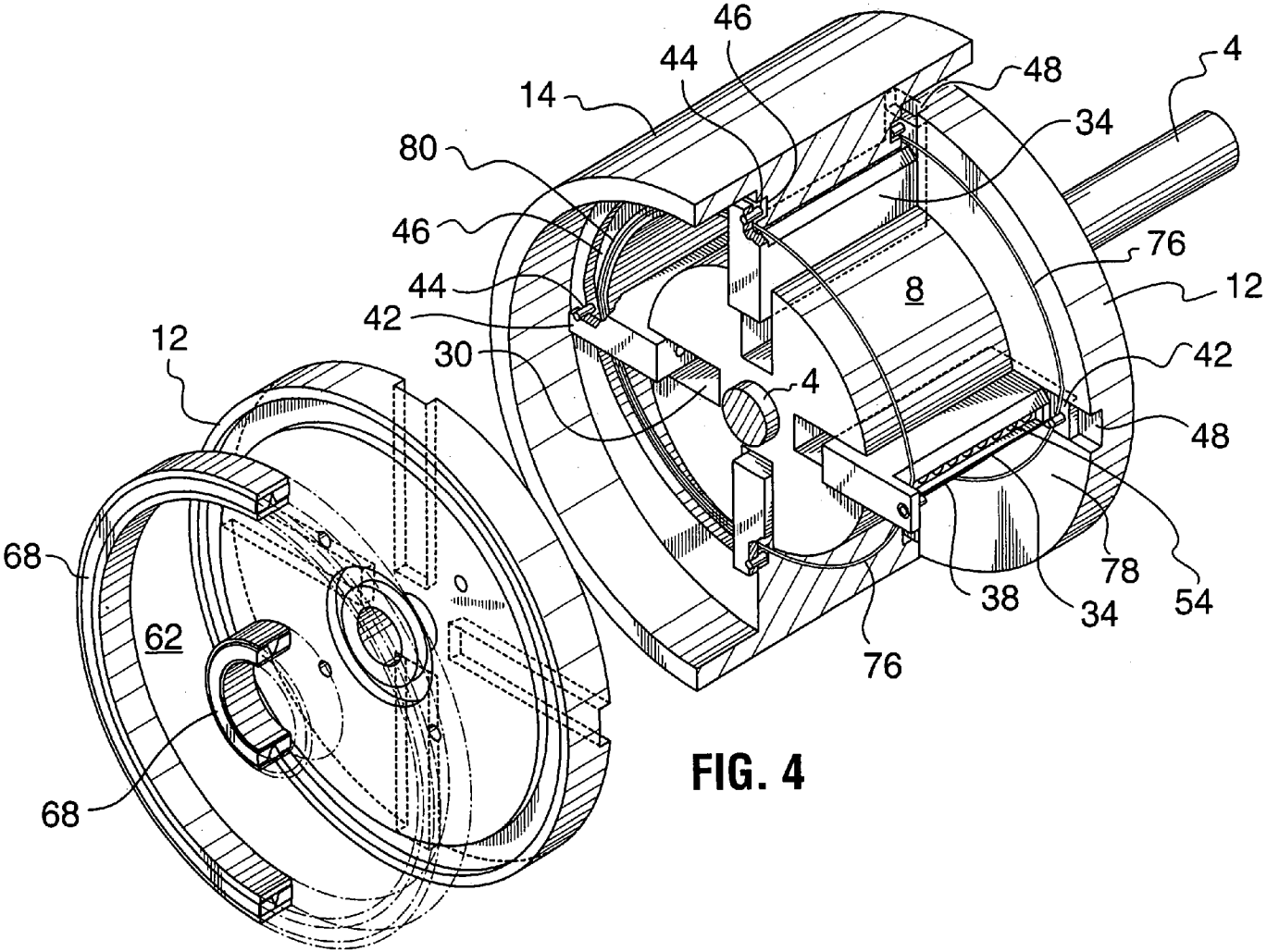
FIG. 4 is a perspective view, partially exploded and in partial section, of the rotary piston of FIG. 1.
Figure 5:
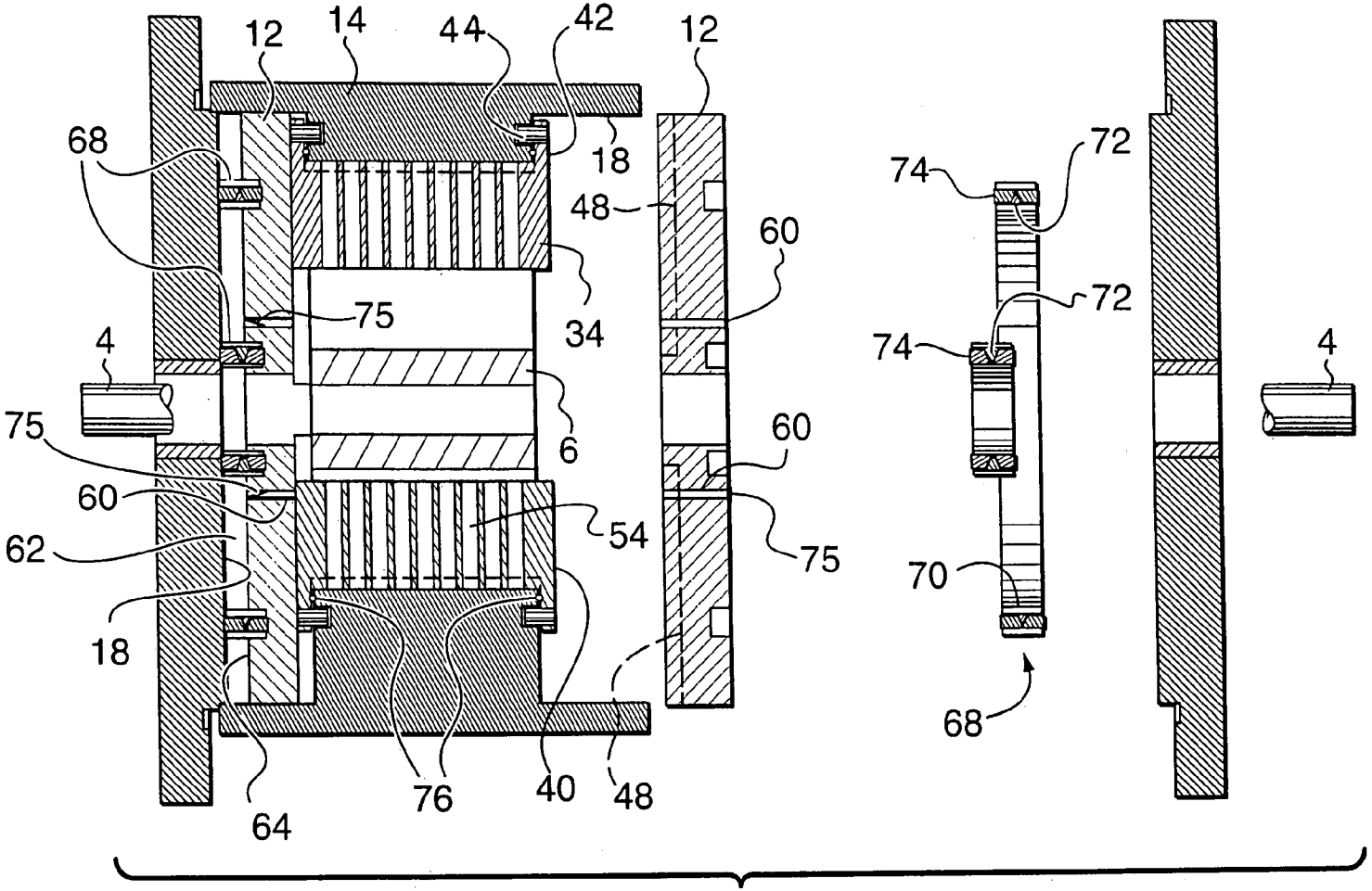
FIG. 5 is a longitudinal section view of the device of FIG. 1.
Figure 6:
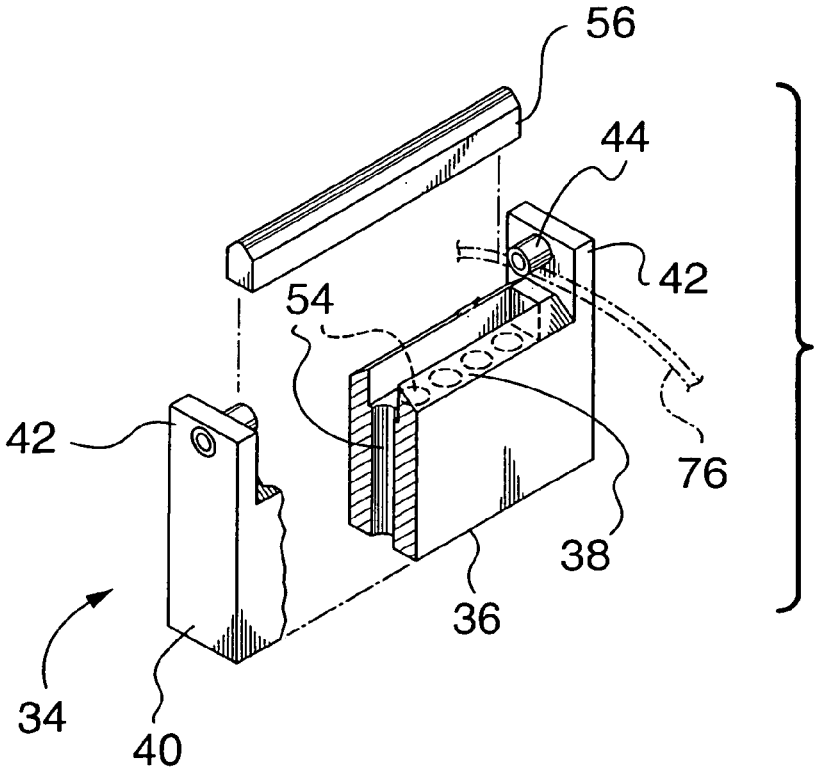
FIG. 6 is a perspective view of an example embodiment of one of the vanes.

As can be seen in FIG. 5, it is preferred that a series of apertures 60 be provided in each rotor disk, from side to side, one such aperture being positioned in each quadrant of the rotor disk between each pair of adjacent slots 48. Each aperture 60 permits passage of high pressure fluid from each compartment 50 between adjacent vanes 34, to the area 62 between the outer end 64 of rotor disk 12 and the corresponding portion of the end wall 18 of housing 14. A pair of annular piston seals 68, constructed as illustrated in cross-section in FIG. 5, are seated on either side of this aperture 60, on this exterior side of rotor disk 12. High pressure fluid on pistons 70 of annular seals 68 drives wedge 72 to expand, outwardly, the body portion 74. It is preferred that a reef valve 75 be associated with aperture 60 so as to lessen the drop in pressure in space 62, when fluid pressure drops in corresponding compartment 50, thereby preserving the effectiveness of seals 68 as lower pressure conditions in the fluid in (right hand in FIG. 3) compartment 50 occur, thereby providing enhanced sealing of the space between rotor disk 12 and end wall 18 against passage of fluid to the other side of these seals. This construction takes pressure off the rotor disks by allowing some of that pressure to be transferred from chamber 50, through aperture 60, to the inner wall 18 of housing 14.

In FIG. 5*a*, on the other side of rotor disk 12 can be seen a further continuous seal 76 of triangular cross-section which fits in a corresponding groove 77 on the interior wall portion 78 of housing 14 and is intended to prevent flow of fluid from the chamber side of that seal between the interior wall 80 of rotor disk 12 and the wall 78 of housing 14 in the vicinity of race 46. The triangular cross-section of seal 76 enables the seal to adjust itself to respond to wear, thereby maintaining its efficiency.

Device 2 according to the present invention permits the development of great torque even at low fluid pressure conditions in compartments 50. While four vanes 16 and a single inlet and outlet 22 and 24 have been illustrated, multiple vanes with multiple inlets and outlets may be provided on a larger rotor construction, using similar principles, to provide even greater torque.

It will be understood that, unlike prior art devices of a similar nature, applicant's device according to the present invention can be reversed in operation with no need to mechanically alter the device. It can be reversed instantly simply by causing the outlet to operate as an inlet and the inlet to operate as an outlet.

Uses envisaged for the device of the present invention include fire water pumps, turbines for driving tractors, military tanks, train engines and other large vehicles where high torque, particularly to commence their motion, is required.

While not illustrated, a plurality of rotary piston devices 2 according to the present invention can be banked together on a common shaft 4 for use for example in a fluid drive transmission (e.g. in bulldozers or the like).

Thus, it is apparent that there has been provided in accordance with the invention an improved vane device that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. A rotary piston device comprising:

a shaft to rotate about a longitudinal axis;

a rotor centrally secured to the shaft, the rotor having a body with a cylindrical surface extending between spaced ends;

a rotor disk secured at each end of the rotor and secured at a centre of the rotor disk to the shaft;

a housing encasing the shaft, the rotor and the rotor disks within an internal cavity, the shaft extending outside of the housing, the housing having interior end walls adjacent to the rotor disks and an interior sidewall, with fluid inlet and fluid outlet ports in the interior sidewall, a first portion of the interior sidewall of the housing being cylindrical and curved with a constant radius over an angle of about approximately 180°, the first portion being spaced a constant distance from confronting portions of the cylindrical surface of the rotor, and a second portion of the interior sidewall of the housing extending between the extremities of the first portion of the interior sidewall, and a curvature of the second portion having a greater radius than a curvature of the first portion;

the cylindrical surface of the rotor being proximal to the interior sidewall of the housing at a point between the fluid inlet and fluid outlet ports about midway along the second portion, the fluid inlet and fluid outlet ports being located in this second portion of the interior sidewall of the housing;

at least three equally spaced, radially oriented slots in the rotor longitudinally extending across the cylindrical surface of the rotor body;

at least three similar vanes, each vane having internal and external edges extending between sides, each vane slidably seated in one of said slots, each vane movable radially in the corresponding slot between an extended position with the external edge of the vane adjacent the interior sidewall of the housing, and a retracted position wherein the external edge of the vane does not extend beyond the cylindrical surface of the rotor, the vanes being spaced from adjacent vanes about the rotor such that there is always at least one vane positioned between the fluid inlet and fluid outlet ports;

an ear extending beyond the external edge of each vane at each of the vane sides and a pin secured to each ear and extending inwardly towards the vane's other ear, the pin of each ear seated in one of a pair of races continuously extending in portions of the interior sidewall of the housing, the races circumscribing the shaft and formed so as to provide proper extending and retracting movement of the vanes as the pins move along the races as the rotor rotates; and a plurality of slots in the rotor disks aligned with the rotor slots and slidably receiving the sides of the vanes and the corresponding ears, the rotor disks, the housing and the vanes constructed so that, during operation of the rotary piston, fluid entering the housing through the inlet port is carried by the rotor, in each of compartments formed between adjacent vanes, the rotor surface between the vanes, the rotor disks and the corresponding portions of the end walls and interior sidewall of the housing, until the adjacent vanes encompass the outlet port whereby the fluid is allowed to leave the housing.

2. The rotary piston device according to claim 1, wherein the rotor is provided with four slots, and one of said vanes slidably seated within each slot of the rotor.

3. The rotary piston device according to claim 1, wherein at least one aperture is provided in each vane, said at least one aperture extending from the external edge to the internal edge of the corresponding vane.

4. The rotary piston device according to claim 3, wherein the external edge of each vane is provided with an external vane seal extending along the external edge, from side to side of the vane, the external vane seal constructed so as to permit a fluid passage from the compartment on one side of the vane to the bottom of the corresponding slot, below the vane, to assist in outward movement of the vane and holding the vane in said extended position while restricting flow of the fluid from said compartment to the compartment on the other side of the vane.

5. The rotary piston device according to claim 4, wherein each external vane seal is movable in a pocket extending along the external edge of the corresponding vane, between first and second positions on the end of the vane so as to provide the fluid passage through said at least one aperture in the corresponding vane from one adjacent compartment when the external vane seal is in said first position and from the other adjacent compartment when the external vane seal is in said second position.

6. The rotary piston device according to claim 4, wherein the external vane seal is made of brass.

7. The rotary piston device according to claim 1, wherein at least one aperture through one of said rotor disks is provided in each quadrant between adjacent slots, and fluid seals are provided on either side of each of said apertures between the corresponding rotor disk and the corresponding interior end wall of the housing.

8. The rotary piston device according to claim 7, wherein a reef valve is provided in each of said apertures through said rotor disk to assist in maintaining positive pressure between the corresponding rotor disk and the housing.

9. The rotary piston device according to claim 7, wherein said seals are in the form of piston seals, whereby increased fluid pressure on the piston seals causes expansion of sides of the piston seals to enhance resistance to passage of fluid past the piston seals.

10. The rotary piston device according to claim 7, wherein a continuous seal is provided between an interior surface of each rotor disk and a portion of the interior sidewall of the housing in which the race is provided, so as to assist in maintaining fluid pressure within the corresponding compartment.

11. The rotary piston device according to claim 1, wherein the shaft, rotor and rotor disks are of integral construction.

12. A rotary piston device comprising:

a shaft to rotate about a longitudinal axis;

a rotor centrally secured to the shaft, the rotor having a body with a cylindrical surface extending between spaced ends;

a rotor disk at each end of the rotor secured to the rotor and secured at a centre of the rotor disk to the shaft;

a housing encasing the shaft, the rotor and the rotor disk within an internal cavity, the shaft extending outside of the housing, the housing having interior end walls adjacent to the rotor disks and an interior sidewall, with fluid inlet and fluid outlet ports in the interior sidewall, a first portion of the interior sidewall of the housing being cylindrical and curved with a constant radius over an angle of about approximately 180°, the first portion being spaced a constant distance from confronting portions of the cylindrical surface of the rotor, and a second portion of the interior sidewall of the housing continuing from the extremities of the first portion of the interior sidewall, and a curvature of the second portion having a greater radius than a curvature of the first portion, the cylindrical surface of the rotor being proximal to the interior sidewall of the housing at a point between the fluid inlet and fluid outlet ports about midway along the second portion, the fluid inlet and fluid outlet ports being located in this second portion of the interior sidewall of the housing;

at least three equally spaced, radially oriented slots in the rotor extending across the cylindrical surface of the rotor body;

at least three similar vanes, each vane having internal and external edges extending between sides, each vane slidably seated in one of said slots, each vane movable radially in the corresponding slot between an extended position with the external edge of the vane adjacent the interior sidewall of the housing, and a retracted position wherein the external edge of the vane does not extend beyond the cylindrical surface of the rotor, the vanes being spaced from adjacent vanes about the rotor such that there is always at least one vane positioned between the fluid inlet and fluid outlet ports;

an ear extending beyond the external edge of each vane at each of the vane sides and a pin secured to each ear and extending inwardly towards the other ear of the vane, the pin of each ear seated in a race continuously extending in a portion of the interior sidewall of the housing, the race circumscribing the shaft and formed so as to provide proper extending and retracting movement of the vanes as the pins move along the races as the rotor rotates;

a plurality of slots in the rotor disks aligned with the rotor slots and slidably receiving the sides of the vanes and the corresponding ears;

the rotor disks, the housing and the vanes constructed so that, during operation of the rotary piston, fluid entering the housing through the inlet port is being carried by the rotor, in each of compartments formed between adjacent vanes, the rotor surface between the vanes, the rotor disks and the corresponding portions of the end walls and interior sidewall of the housing, until the adjacent vanes encompass the outlet port whereby the fluid is allowed to leave the housing;

at least one aperture is provided in each vane, said at least one aperture extending from the external edge to the internal edge of the corresponding vane, the external edge of each vane being provided with an external vane seal extending along the external edge, from side to side of the vane, the external vane seal constructed so as to permit fluid a passage from the compartment on one side of the vane to the bottom of the corresponding slot, below the vane, to assist in outward movement of the vane and holding the vane in said extended position while restricting flow of the fluid from said compartment to the compartment on the other side of the vane;

each external vane seal being movable in a pocket extending along the external edge of the corresponding vane, between first and second positions on the end of the vane so as to provide the fluid passage through said at least one aperture in the corresponding vane from one adjacent compartment when the external vane seal is in said first position and from the other adjacent compartment when the seal is in said second position; and at least one aperture through one of said rotor disks is provided in each quadrant between adjacent slots and fluids seals are provided on either side of each of said aperture between the corresponding rotor disk and the corresponding interior end of the wall of the housing.

* * * * *